US007394197B2

(12) United States Patent
Song

(10) Patent No.: US 7,394,197 B2
(45) Date of Patent: Jul. 1, 2008

(54) PLASMA DISPLAY PANEL

(75) Inventor: Jung-Suk Song, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 308 days.

(21) Appl. No.: 11/251,834

(22) Filed: Oct. 18, 2005

(65) Prior Publication Data

US 2006/0082303 A1 Apr. 20, 2006

(30) Foreign Application Priority Data

Oct. 19, 2004 (KR) ..... 10-2004-0083503

(51) Int. Cl.
*H01J 17/49* (2006.01)

(52) U.S. Cl. ..... 313/582; 313/584

(58) Field of Classification Search ..... 313/581–587
See application file for complete search history.

(56) References Cited

U.S. PATENT DOCUMENTS 6,051,928 A * 4/2000 Choi et al. ..... 313/582
6,100,633 A * 8/2000 Okumura et al. ..... 313/486
6,172,461 B1 * 1/2001 Ha ..... 313/585

FOREIGN PATENT DOCUMENTS

| | | |
|---|---|---|
| JP | 2003-303546 | 10/2003 |
| KR | 10-2002-0020310 | 3/2002 |
| KR | 2003-0013036 | 2/2003 |

* cited by examiner

*Primary Examiner*—Vip Patel
(74) *Attorney, Agent, or Firm*—H.C. Park & Associates, PLC

(57) ABSTRACT

A plasma display panel including a first substrate, a second substrate arranged substantially parallel to the first substrate, and barrier ribs arranged between the first and second substrates and defining discharge cells. A plurality of first discharge electrodes are arranged in the discharge cells, and a plurality of second discharge electrodes are arranged in a direction crossing the first discharge electrodes and below the barrier ribs. A minimum area of the second discharge electrodes required for addressing protrudes towards the discharge cells.

20 Claims, 4 Drawing Sheets

PLASMA DISPLAY PANEL

CROSS REFERENCE TO RELATED APPLICATION

This application claims priority to and the benefit of Korean Patent Application No. 10-2004-0083503, filed on Oct. 19, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP including electrodes that compensate for different discharge characteristics of differently colored discharge cells.

2. Discussion of the Background

Generally, plasma display panels (PDPs) include front and rear panels facing each other with a plurality of discharge cells therebetween. Discharge electrodes arranged on the panels generate a discharge within the discharge cells, which contain a discharge gas, thereby generating ultraviolet (UV) rays. The UV rays excite a phosphor layer within the discharge cells to emit light that forms visible images.

Such PDPs may be direct current (DC) PDPs or alternating current (AC) PDPs depending on the driving voltage applied to the discharge cells. Further, they may be facing discharge PDPs or surface discharge PDPs according to electrode configuration.

In a conventional three-electrode surface discharge PDP, barrier ribs may be arranged between the front and rear panels to define a plurality of pixels. A phosphor layer is coated on surfaces of the barrier ribs, and vacuum UV rays are converted into visible rays through the phosphor layer, thereby displaying an image with the pixels. However, before a pixel is discharged to display an image, signals are transmitted to the corresponding address electrodes.

In a method of manufacturing a rear panel, address electrodes, which are used to generate an address discharge to select discharge cells, are formed on the rear panel, a dielectric layer is printed on the address electrodes, barrier ribs are formed on the dielectric layer, and red, green, and blue phosphor layers are formed on the sides of the barrier ribs. The address electrodes may be formed in strips.

FIG. 1 is a view showing discharge electrodes, as disclosed in Korean Laid Open Patent Application No. 2003-13036, and FIG. 2 is a view showing a PDP including the discharge electrodes of FIG. 1.

Referring to FIG. 1 and FIG. 2, display electrodes 16 and scanning electrodes 18 are alternately disposed, and address electrodes 14 are disposed in a direction crossing the display electrodes 16 and the scanning electrodes 18. Additionally, barrier ribs 12 of the strip pattern are disposed in non-discharge areas to partition discharge cells.

The address electrodes 14 include non-conductive regions 14*a* where the address electrodes 14 face the display electrodes 16. The non-conductive regions 14*a* do not include any address electrode material, they correspond to the display electrodes 16, and they are formed entirely within the address electrodes 14.

The address electrodes 14 structured as described above have reduced areas where they face the display electrodes 16. Thus, charges generated in address periods accumulate on a region of a transparent dielectric layer 20 covering the scanning electrodes 18 and on a region of a dielectric layer 22, which covers the address electrodes 14, facing the scanning electrodes 18. Substantially no charges accumulate on the dielectric layer 22 above the non-conductive regions 14*a*.

As such, the non-conductive regions 14*a* prevent charges from accumulating on the dielectric layer 22 facing the display electrodes 16 and from traveling towards the display electrodes 16 to accumulate on the transparent dielectric layer 20 at the display electrodes 16.

Thus, when selectively discharging display cells by applying a discharge sustain voltage Vs between scanning electrodes 16 and display electrodes 18, if wall charges do not accumulate towards the display electrodes 16 as described above, a difference between the amount of wall charges predicted during designing and the amount of wall charges generated by actually applying an address voltage may be minimized.

Although the conventional strip type address electrodes 14 may improve erroneous discharge, designing a PDP that may adjust the discharge characteristics of discharge cells coated with red, green, and blue phosphor layers, as well as decrease electric field interference between neighboring address electrodes 14 in adjacent discharge cells, is desired.

SUMMARY OF THE INVENTION

The present invention provides a PDP that may prevent erroneous discharge during operation while decreasing power consumption when addressing.

The present invention also provides a PDP with electrodes that may adjust different discharge characteristics for differently colored discharge cells to be the same, and minimize electric field interference between neighboring address electrodes.

Additional features of the invention will be set forth in the description which follows, and in part will be apparent from the description, or may be learned by practice of the invention.

The present invention discloses a PDP including a first substrate; a second substrate arranged substantially parallel to the first substrate, barrier ribs arranged between the first substrate and the second substrate and defining discharge cells, a plurality of first discharge electrodes arranged in the discharge cells, and a plurality of second discharge electrodes arranged in a direction crossing the first discharge electrodes and below the barrier ribs. A minimum area of the second discharge electrodes required for addressing protrudes towards the discharge cells.

The present invention also discloses a PDP including a first substrate, a second substrate, arranged substantially parallel to the first substrate, barrier ribs arranged between the first substrate and the second substrate and defining discharge cells, and an address electrode including a first portion and a plurality of second portions coupled with the first portion. The first portion is arranged in a non-light emitting area, the second portions are arranged in discharge cells, and the second portions vary according to discharge cell characteristics.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
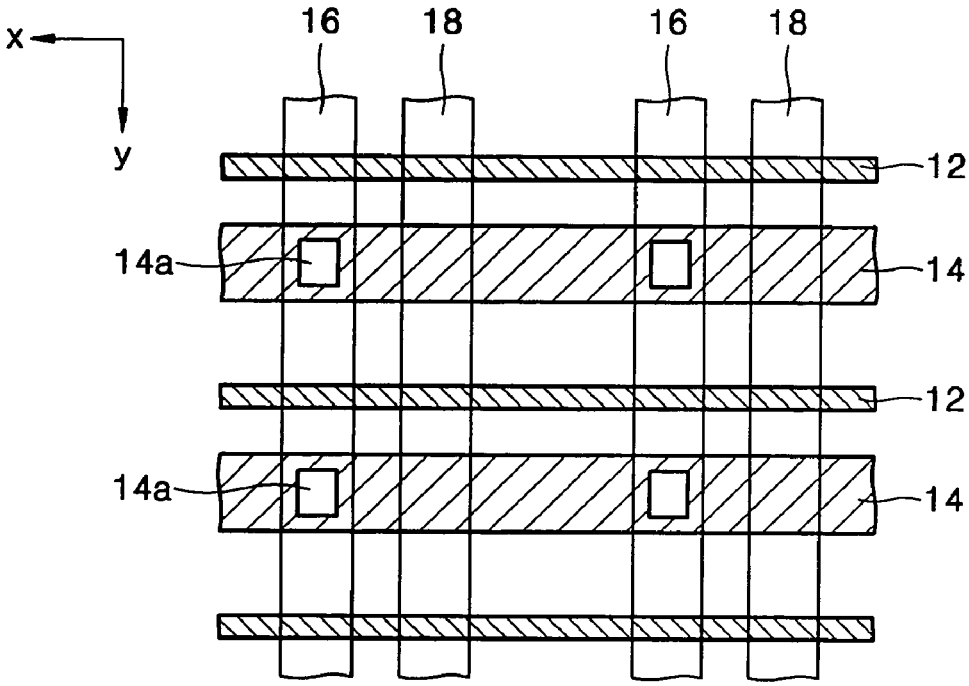
FIG. 1 (PRIOR ART)
FIG. 1 is a view showing a conventional PDP discharge electrode arrangement.
Figure 2:
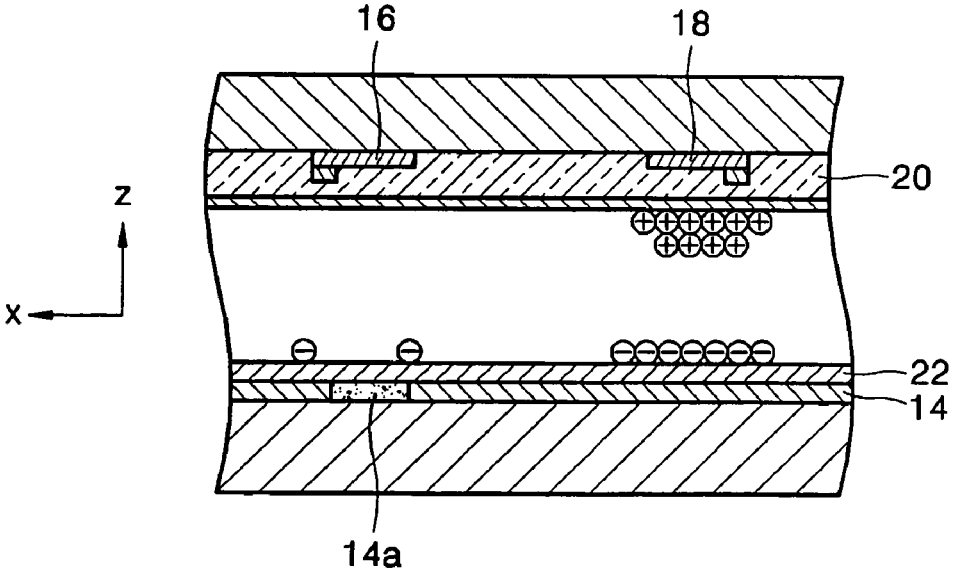
FIG. 2 (PRIOR ART)
FIG. 2 is a view showing a PDP including the discharge electrodes of FIG. 1.

The present invention will now be described more fully with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 3:
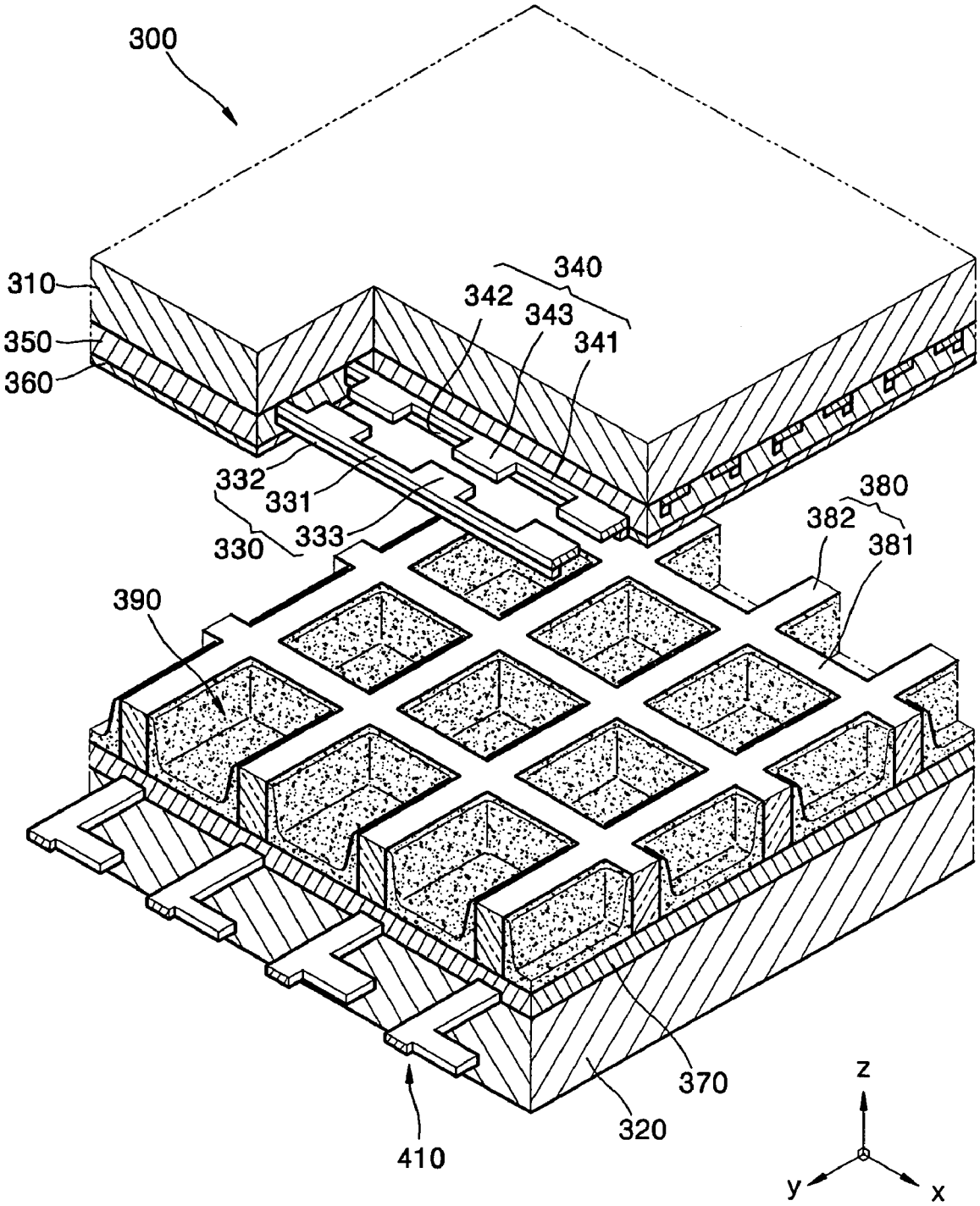
FIG. 3 is an exploded perspective view showing a PDP according to a first exemplary embodiment of the present invention.

FIG. 3 is an exploded perspective view showing a PDP 300 according to a first exemplary embodiment of the present invention.

Referring to FIG. 3, the PDP 300 includes a front substrate 310 and a rear substrate 320 arranged substantially in parallel with each other. The front and rear substrates 310 and 320 may be coupled together using frit glass coated along the edges of inner surfaces of the front and rear substrates 310 and 320.

The transparent front substrate 310 may be made of soda lime glass. X and Y electrodes 330 and 340 are formed substantially in parallel to each other on the front substrate 310 along the X direction of the PDP 300. The X and Y electrodes 330 and 340 are alternately arranged along the Y direction of the PDP 300.

The X electrodes 330 include transparent first electrode lines 331 and first bus lines 332 coupled with the first electrode lines 331. The first bus lines 332 are formed along an edge of the first electrode lines 331.

Similarly, the Y electrodes 340 include transparent second electrode lines 341 and second bus lines 342 coupled with the second electrode lines 341. The second bus lines 342 are formed along an edge of the second electrode lines 341.

One first electrode line 331 and one second electrode line 341 are arranged in each discharge cell. The X and Y electrodes 330 and 340 may include first and second protrusions 333 and 343, respectively, facing each other in the discharge cells.

The first and second electrode lines 331 and 341 may be made of a transparent conductive film, such as indium tin oxide (ITO), so that light may transmit through the electrode lines. The first and second bus lines 332 and 342 may be made of highly conductive metals, such as for example, Ag paste, Cr—Cu—Cr alloy, etc. to reduce the line resistance of the first and second electrode lines 331 and 341 and improve electric conductivity.

Here, a space between one pair of X and Y electrodes 330 and 340 and an adjacent pair of X and Y electrodes 330 and 340 is a non-discharge region. A black strip layer may be formed in the non-discharge region to improve contrast.

A front dielectric layer 350 covers the X and Y electrodes 330 and 340. The front dielectric layer 350 may be formed by adding various fillers to a glass paste. The front dielectric layer 350 may be selectively printed where the X and Y electrodes 330 and 340 are formed, or it may cover the bottom surface of the front substrate 310 including the X and Y electrodes. A protective layer 360, which may be made of magnesium oxide (MgO), covers the front dielectric layer 350 to prevent damage to the front substrate 310 and increase secondary electron emission.

Address electrodes 410 are formed on the rear substrate 320 and are covered by a rear dielectric layer 370. The address electrodes 410 are arranged in a direction crossing the X and Y electrodes 330 and 340.

Barrier ribs 380 are formed between the front and rear substrates 310 and 320 to define discharge cells together with the front and rear substrates 310 and 320. The barrier ribs 380 include first barrier ribs 381, which are arranged along the X direction of the front and rear substrates 310 and 320, and second barrier ribs 382, which are arranged along the Y direction of the front and rear substrates 310 and 320. The first barrier ribs 381 extend as a single body in a direction opposite to an inner wall of a pair of adjacent second barrier ribs 382, thereby forming a matrix.

The barrier ribs may be formed in various configurations. For example, the barrier ribs may be meander type, delta type, honeycomb type, etc., or they may be formed in strips extending along the same direction as the address electrodes 410. Further, the discharge cells partitioned by the barrier ribs may have numerous structures in addition to that shown in FIG. 3. For example, the discharge cells may have other polygonal shapes or a circular shape.

A discharge gas, such as Ne—Xe or He—Xe, is injected into the discharge cells.

Additionally, red, green, and blue phosphor layers 390 are arranged in the discharge cells. The red, green, and blue phosphor layers 390 may be coated on any region of the discharge cells, but in the present embodiment, they are coated on sides of the barrier ribs 380 and the rear dielectric layer 370. For example, the red phosphor layer may be made of (Y, Gd) $BO_3:Eu^{+3}$, the green phosphor layer may be made of $Zn_2SiO_4:Mn^{2+}$, and the blue phosphor layer may be made of $BaMgAl_{10}O_{17}:Eu^{2+}$.

Here, the address electrodes 410 are arranged to correspond to one of the directions the barrier ribs 380 extend, and only minimum regions needed for addressing are protruded. The area or thickness of the address electrode protrusions 410 arranged in at least one of the red, green, and blue discharge cells differs from the area or thickness of the address electrode protrusions 410 arranged in the other discharge cells.

Figure 4:
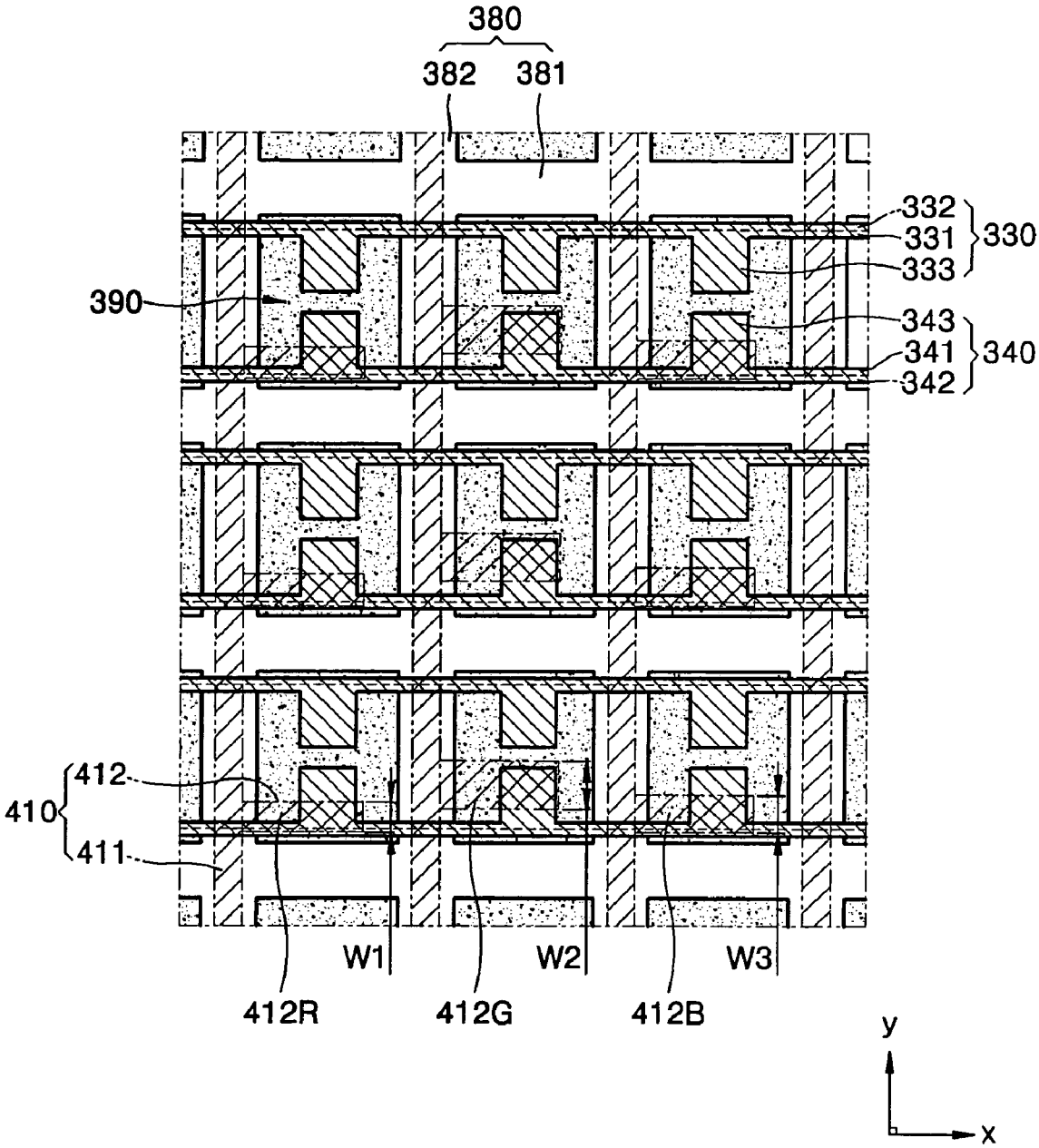
FIG. 4 is an enlarged view showing an arrangement of discharge electrodes of FIG. 3.

In more detail, referring to FIG. 4, the barrier ribs 380 include the first barrier ribs 381 arranged along the X direction of the PDP 300 and the second barrier ribs 382 arranged along the Y direction of the PDP 300. The first and second barrier ribs 381 and 382 partition the discharge cells into a matrix when they are coupled. A red, green, or blue phosphor layer 390 is arranged in the discharge cells.

Additionally, the X and Y electrodes 330 and 340 are arranged to face each other in the discharge cells. That is, the X electrodes 330 traverse adjacent discharge cells arranged in the X direction of the PDP 300. The X electrodes 330 include the first protrusions 333, which have a predetermined width and protrude from the first electrode lines 331 towards the Y electrodes 340.

Furthermore, the Y electrodes 340 traverse adjacent discharge cells arranged in the X direction of the PDP 300, and they are disposed opposite the X electrodes 330 in the discharge cells. The Y electrodes 340 include the second protrusions 343, which have a predetermined width and protrude from the second electrode lines 341 towards the X electrodes 330. While the first and second protrusions 333 and 343 are shown as rectangles, they may have various shapes.

The address electrodes 410 are arranged in a direction crossing the X and Y electrodes 330 and 340. Here, the address electrodes 410 are arranged corresponding to the second barrier ribs 382.

That is, address bus lines 411 are arranged to correspond to the second barrier ribs 382, which are arranged in the Y direction of the PDP 300. Hence, the address electrode lines 411, which are in strip form, are arranged along the same direction as the second barrier ribs 382. Additionally, the address electrode lines 411 are narrower than the second barrier ribs 382.

Third protrusions 412 are formed on the address electrode lines 411 to generate an address discharge with the Y electrodes 340. The third protrusions 412 extend as a single body toward the X direction of the PDP 300 and in a direction substantially perpendicular to the address electrode lines 411. The third protrusions 412 protrude into the discharge cells from the address electrode lines 411 as much as a minimum area needed for addressing.

The third protrusions 412 of the address electrodes 410 are arranged corresponding to the second protrusions 343 of the Y electrodes 340. The third protrusions 412 may have various shapes, including the rectangular shape shown in FIG. 4.

Accordingly, a single address electrode 410 includes the address electrode line 411, which is arranged along the Y direction of the PDP 300, and the third protrusions 412, which are of a predetermined size and protrude into the discharge cells from one side of the address electrode 410. The address electrode line 411 and the third protrusions 412 may be formed as a single body.

Here, the address electrodes 410 do not have the same sized third protrusions 412 for each of the red, green, and blue discharge cells. Rather, a third protrusion 412 arranged in a discharge cell having relatively unfavorable discharge characteristics is wider than a third protrusion 412 arranged in a discharge cell having relatively favorable discharge characteristics.

For example, assuming that the red, blue, and green discharge cells have increasingly unfavorable discharge characteristics in the order they are listed, a third protrusion 412G arranged in each green discharge cell relatively has the least favorable discharge, and thus the third protrusion 412G has the widest width $W_2$ among the third protrusions. Conversely, a third protrusion 412R arranged in each red discharge cell relatively has the most favorable discharge, and thus the third protrusion 412R has the narrowest width $W_1$ among the third protrusions. A width $W_3$ of a third protrusion 412B arranged in each blue discharge cell is between the widest width $W_2$ and the narrowest width $W_1$. Consequently, the discharge characteristics of the red, green, and blue discharge cells may be adjusted to be substantially the same.

As such, by varying the area of the address electrodes 410 according to the discharge characteristics of the red, green, and blue discharge cells, a uniform discharge voltage margin may be obtained in the discharge cells.

Additionally, the third protrusions 412R, 412G and 412B may be placed on the same virtual straight line along the X direction of the PDP 300 with the same geometric center. However, at least one center of the third protrusions 412R, 412G and 412B preferably deviates from the centers of the other third protrusions 412R, 412G and 412B.

For example, the third protrusions 412G in the green discharge cells may not be arranged on the same straight line in the X direction of the PDP 300 as the adjacent third protrusions 412R and 412B. Instead, the centers of the third protrusions 412G are arranged a predetermined distance from the centers of the third protrusions 412R and 412B in the Y direction of the PDP 300. Accordingly, the third protrusions 412R, 412G, and 412B are arranged in a zigzag form.

The third protrusions 412R, 412G, and 412B may be arranged in a zigzag form to substantially eliminate electric field interference to other discharge cells during operation, thereby preventing erroneous discharge.

An operation of the PDP 300 having the above-described structure will be described below.

First, applying a predetermined voltage between the address electrodes 410 and the Y electrodes 340 generates an address discharge, thereby selecting discharge cells to be emitted. Wall charges accumulate on inner walls of the selected discharge cells.

Here, in the address electrodes 410, the strip-type address electrode lines 411 are arranged below the second barrier ribs 382, and the third protrusions 412, which have a minimum area needed for addressing, protrude from the address electrode lines 411 into the discharge cells.

As such, the address electrodes 410 arranged in the red, green, and blue discharge cells may prevent erroneous discharge by reducing the area of the address electrodes 410 corresponding to the Y electrodes to prevent electric field interference among adjacent discharge cells. Additionally, forming the areas of the third protrusions 412 of the address electrodes 410 to be different per different colored discharge cells may compensate for the discharge cells with relatively unfavorable discharge characteristics.

After wall charges are accumulated on inner walls of the selected discharge cells, a ground voltage is applied to the X electrodes 330 and a relatively higher voltage is applied to the Y electrodes 340. Thus, the wall charges travel by the voltage difference applied between the X and Y electrodes 330 and 340.

The wall charges travel and produce a discharge by colliding with discharge gas atoms inside the discharge cells, thereby generating plasma. The discharge starts between the X and Y electrodes 330 and 340, where a relatively strong electric field is formed, and expands outward.

After the discharge is formed through this method, when the voltage difference between the X and Y electrodes 330 and 340 falls below a discharge voltage, the discharge no longer occurs, and space charges and wall charges are formed in the discharge cells.

Here, if the polarity of the voltages applied to the X and Y electrodes 330 and 340 switches, discharge may occur again with the help of the wall charges. As such, by switching the polarity of the X and Y electrodes 330 and 340, the initial discharge process may be repeated. By repeating this process, discharge may be stably produced.

Here, the UV rays generated by the discharge exite phosphor materials of the red, green, and blue phosphor layers 390. Through this process, visible rays may be generated. The generated visible rays are emitted from the discharge cells to display images.

Figure 5:
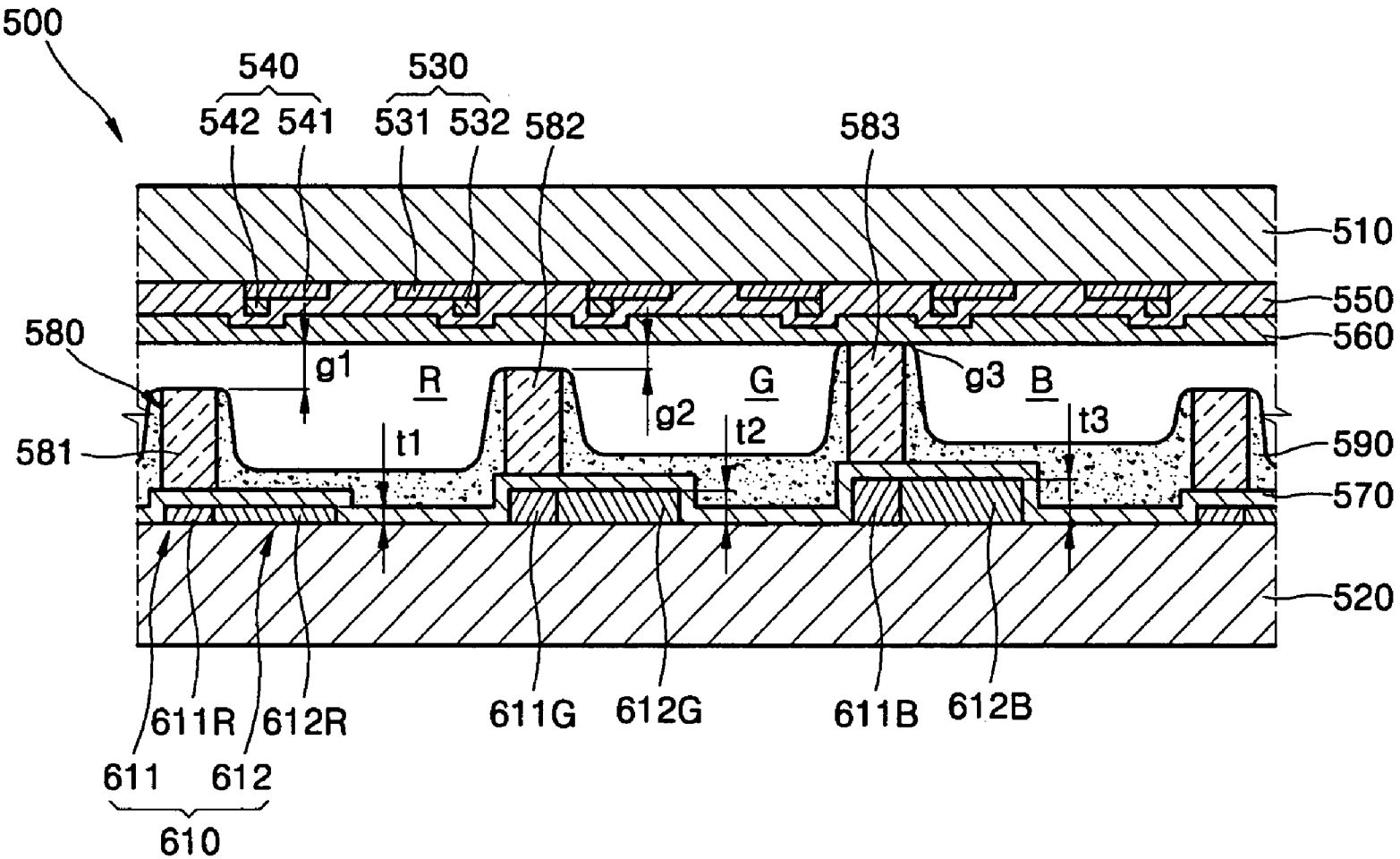
FIG. 5 is a cross-sectional view showing a PDP according to a second exemplary embodiment of the present invention.

FIG. 5 is a cross-sectional view showing a PDP 500 according to a second exemplary embodiment of the present invention.

Referring to FIG. 5, the PDP 500 includes a front substrate 510 and a rear substrate 520 arranged substantially in parallel with each other.

X and Y electrodes 530 and 540 are arranged on the front substrate 510 in the discharge cells. The X electrodes 530 include first electrode lines 531, which are made of a transparent material, and first bus lines 532, which are made of a metallic material and are arranged on an edge of the first electrode lines 531. The Y electrodes 540 include second electrode lines 541, which are made of a transparent material, and second bus lines 542, which are made of a metallic material and are arranged on an edge of the second electrode lines 541. A front dielectric layer 550 covers the X and Y electrodes 530 and 540, and a protective layer 560 covers the front dielectric layer 550.

Address electrodes 610 are arranged on the rear substrate 520 in a direction crossing the X and Y electrodes 530 and 540. A rear dielectric layer 570 covers the address electrodes 610.

Additionally, barrier ribs 580 are arranged between the front and rear substrates 510 and 520 to define discharge cells, and red, green, and blue phosphor layers 590 are coated on sides of the barrier ribs 580 and the rear dielectric layer 570.

The address electrodes 610 include address electrode lines 611, which are formed in strips arranged below the barrier ribs 580, and fourth protrusions 612, which protrude from the address electrode lines 611 into the discharge cells as much as a minimum region required for addressing, as in the first exemplary embodiment of the present invention. The address electrode lines 611 and the fourth protrusions 612 may be equally thick, and they may be formed as a single body.

Here, the address electrodes 610 may prevent erroneous discharge during an addressing operation, and the address electrodes 610 have different thicknesses in the red, green, and blue discharge cells so that the cells may have substantially the same discharge characteristics. Consequently, a path through which impure gas may be exhausted is formed inside the discharge cells.

That is, assuming that the red, green, and blue phosphor layers 590 have decreasingly favorable discharge characteristics in the order they are listed, the fourth protrusions 612B arranged in blue discharge cells, which have relatively the least favorable discharge, have a thickest thickness $t_3$ among the fourth protrusions 612R, 612G and 612B. Conversely, the fourth protrusions 612R arranged in red discharge cells, which have relatively the most favorable discharge, have a thinnest thickness $t_1$ among the fourth protrusions 612R, 612G and 612B. A thickness $t_2$ of the fourth protrusions 612G arranged in green discharge cells is between the thickness $t_3$ and the thickness $t_1$. Consequently, the discharge characteristics of the red, green, and blue discharge cells may be adjusted by the thickness difference of the address electrodes 610.

When performing front side printing on the rear substrate 520, the rear dielectric layer 570, which covers the address electrodes 610, is formed in steps per discharge cells due to the thickness difference of the address electrodes 610. Consequently, the barrier ribs 580 formed on the rear substrate 520 are arranged a distance g away from the front substrate 510.

That is, a distance $g_1$, between barrier ribs 581, which correspond to red electrode lines 611R with the thinnest thickness $t_1$, and the front substrate 510 is the largest, a distance $g_3$ between barrier ribs 583, which correspond to blue address electrode lines 611B with the thickest thickness $t_3$, and the front substrate 510 is substantially zero, and a distance $g_2$ between barrier ribs 582, which corresponds to green address electrode lines 611G, is between the distance $g_1$ and the distance $g_3$. Here, the barrier ribs 581, 582 and 583 have substantially the same height.

The distances $g_1$ and $g_2$ form a path between the front substrate 510 and the barrier ribs 580 through which impure gas may be exhausted during vacuum exhaustion. Thus, all impure gas may be substantially removed from inside the PDP 500.

As described above, a PDP according to exemplary embodiments of the present invention may have the following effects.

Since address electrode lines are arranged below barrier ribs and protrusions protrude into discharge cells with only a minimum area required for addressing, the area of address electrodes may decrease. As a result, the PDP may operate with lower current, and erroneous discharge may be prevented.

Also, forming the address electrodes with different areas per discharge cell color may adjust the discharge characteristics to be substantially the same.

Further, since the protrusions, which protrude only a minimum area required for addressing, are disposed in the discharge cells, electric field interference between address electrodes of adjacent discharge cells may be minimized, thereby obtaining stable discharge characteristics.

Additionally, varying a distance between the substrate and the barrier ribs provides a path through which impure gas may be exhausted. Accordingly, discharge efficiency may be improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate;

a second substrate arranged substantially parallel to the first substrate;

barrier ribs arranged between the first substrate and the second substrate and defining discharge cells;

a plurality of first discharge electrodes arranged in the discharge cells; and a plurality of second discharge electrodes arranged in a direction crossing the first discharge electrodes and below the barrier ribs, wherein a minimum area of the second discharge electrodes required for addressing protrudes towards the discharge cells.

2. The PDP of claim 1, wherein the second discharge electrodes comprise:

discharge electrode lines arranged substantially parallel to the barrier ribs; and protrusions protruding from the discharge electrode lines toward the discharge cells.

3. The PDP of claim 2, wherein the discharge electrode lines comprise strips between adjacent discharge cells, and the protrusions are arranged in the discharge cells by protruding in a single body from a side of the discharge electrode lines.

4. The PDP of claim 2, wherein the protrusions are arranged to correspond to areas of the first discharge electrodes where an addressing discharge occurs.

5. The PDP of claim 2, wherein the discharge electrode lines are narrower than the barrier ribs.

6. The PDP of claim 2, wherein in the second discharge electrodes, an area of protrusions arranged in discharge cells comprising a first color phosphor layer is different from an area of protrusions arranged in discharge cells comprising a second color phosphor layer.

7. The PDP of claim 6, wherein the area of the protrusions arranged in the discharge cells comprising the first color phosphor layer is larger than the area of the protrusions arranged in the discharge cells comprising the second color phosphor layer, the first color phosphor layer having less favorable discharge characteristics than the second color phosphor layer.

8. The PDP of claim 2, wherein the protrusions are arranged in a zigzag form along a line of differently colored discharge cells.

9. The PDP of claim 2, wherein in the second discharge electrodes, a thickness of protrusions arranged in discharge cells comprising a first color phosphor layer is different from a thickness of protrusions arranged in discharge cells comprising a second color phosphor layer.

10. The PDP of claim 9, wherein the protrusions arranged in the discharge cells comprising the first color phosphor layer are thicker than the protrusions arranged in the discharge cells comprising the second color phosphor layer, the first color phosphor layer having less favorable discharge characteristics than the second color phosphor layer.

11. The PDP of claim 9, wherein the thickness of the protrusions is substantially the same as a thickness of the discharge electrode lines.

12. The PDP of claim 11, wherein a path is formed between the first substrate and the barrier ribs due to a thickness deviation of the second discharge electrodes in each of the discharge cells so that an impure gas can be exhausted through the path during a vacuum exhaustion.

13. The PDP of claim 12, wherein a distance between the first substrate and the second discharge electrodes arranged in discharge cells with relatively lowest discharge characteristics is greater than a distance between the first substrate and the second discharge electrodes arranged in discharge cells with relatively highest discharge characteristics.

14. The PDP of claim 1, wherein the first discharge electrodes comprise pairs of X electrodes and Y electrodes, and the second discharge electrodes comprise address electrodes.

15. The PDP of claim 14, wherein the X electrodes and the Y electrodes comprise first protrusions and second protrusions, respectively, facing each other in the discharge cells, and the address electrodes comprise third protrusions that correspond to the second protrusions.

16. The PDP of claim 14, further comprising:

a first dielectric layer; and a second dielectric layer, wherein the X electrodes and the Y electrodes are alternately arranged on an inner surface of the first substrate and are covered by the first dielectric layer, and wherein the second discharge electrodes are arranged on an inner surface of the second substrate and are covered by the second dielectric layer.

17. A plasma display panel (PDP), comprising:

a first substrate;

a second substrate arranged substantially parallel to the first substrate;

barrier ribs arranged between the first substrate and the second substrate and defining discharge cells; and an address electrode comprising a first portion and a plurality of second portions coupled with the first portion, wherein the first portion is arranged in a non-light emitting area and the second portions are arranged in discharge cells, the second portions varying according to discharge cell characteristics.

18. The PDP of claim 17, wherein an area of the second portions varies according to discharge cell color.

19. The PDP of claim 17, wherein a thickness of the second portions varies according to discharge cell color.

20. The PDP of claim 17, wherein a barrier rib covers the first portion.

* * * * *